US011478036B2

(12) United States Patent
Dumph

(10) Patent No.: US 11,478,036 B2
(45) Date of Patent: Oct. 25, 2022

(54) ADJUSTABLE TACTICAL HELMET RETENTION HARNESS

(71) Applicant: Hard Head Veterans LLC, Rollinsville, CO (US)

(72) Inventor: Christopher Dumph, Blackhawk, CO (US)

(73) Assignee: Hard Head Veterans LLC, Rollinsville, CO (US)

( * ) Notice: Subject to any disclaimer, the term of this patent is extended or adjusted under 35 U.S.C. 154(b) by 249 days.

(21) Appl. No.: 17/091,367

(22) Filed: Nov. 6, 2020

(65) Prior Publication Data

US 2022/0132972 A1 May 5, 2022

Related U.S. Application Data

(60) Provisional application No. 63/110,183, filed on Nov. 5, 2020.

(51) Int. Cl.
*A42B 3/08* (2006.01)

(52) U.S. Cl.
CPC ..... *A42B 3/08* (2013.01)

(58) Field of Classification Search
CPC ..... A42B 3/08; A42B 3/085; A42B 3/145
See application file for complete search history.

(56) References Cited

U.S. PATENT DOCUMENTS

| | | | | | |
|---|---|---|---|---|---|
| 2,769,176 | A * | 11/1956 | Grancsay | A42B 3/14 | 2/421 |
| 3,187,342 | A * | 6/1965 | Aileo | A42B 3/08 | 2/421 |
| 4,051,556 | A * | 10/1977 | Davenport | A42B 3/08 | 2/421 |
| 8,959,668 | B1 * | 2/2015 | Ganes | A42B 3/205 | 2/9 |
| 11,391,546 | B2 * | 7/2022 | Banducci | A42B 3/142 | |
| 2014/0068844 | A1 * | 3/2014 | Infusino | A42B 3/08 | 2/421 |
| 2016/0007670 | A1 * | 1/2016 | Connelly | A42B 3/08 | 2/9 |
| 2018/0084858 | A1 * | 3/2018 | Schiebl | A42B 3/08 | |
| 2019/0216155 | A1 * | 7/2019 | Zents | A42B 3/063 | |

* cited by examiner

*Primary Examiner* — Tajash D Patel
(74) *Attorney, Agent, or Firm* — Jenei LLC

(57) ABSTRACT

A helmet retention harness of a tactical helmet includes a one-handed manual adjustment assembly to adjust an effective longitudinal length of a combination of a static first strap and an adjustable second strap. The static strap is attached to one side of a first strap slider. The adjustable second strap slides on another side of the first strap slider and is attached to a second strap slider have a cross bar that slides along the adjustable second strap. Tightening and loosening strap portions extend away from each side of the second strap slider enabling a wearer of the tactical helmet to readily pull on a selected strap portion to either tighten or loosen the helmet retention harness while wearing the tactical helmet.

6 Claims, 3 Drawing Sheets

ADJUSTABLE TACTICAL HELMET RETENTION HARNESS

CLAIM OF PRIORITY UNDER 35 U.S.C. § 119

The present Applications for patent claims priority to Provisional Application No. 63/110,183 entitled "ADJUSTABLE TACTICAL HELMET RETENTION HARNESS", filed 5 Nov. 2020, assigned to the assignee hereof and hereby expressly incorporated by reference herein.

FIELD OF THE INVENTION

The present disclosure generally relates to tactical helmet retention harnesses, and more particular to tactical helmet retention harnesses having a manual adjustment feature.

BACKGROUND OF THE INVENTION

Tactical helmets generally include a helmet shell, liner, and a helmet retention harness. The helmet shell provides ballistic or impact protection to the head. For comfort and to spread impact forces, a shock absorbing liner is attached to an inner surface of the helmet shell. An upper portion of a head of wearer contacts e liner. To retain the helmet shell and liner on the head of the wearer, the helmet retention harness is attached to the helmet shell and engages the chin and nape of the neck of the wearer. Proper adjustment of the helmet retention harness is required for comfort and effective retention of the tactical helmet. Being able to adjust the helmet retention harness with one hand while the tactical helmet is being worn can be a mission requirement.

SUMMARY OF THE INVENTION

In one aspect, the present disclosure provides a helmet retention harness having a one handed manual adjustment (OHMA) assembly. The OHMA includes a first strap slider, a second strap slider, a static first strap, an adjustable second strap, a tightening strap portion; and a loosening strap portion. The first strap slider has first and second opposing strap sides. The second strap slider has a crossbar between first and second opposing strap sides. The static first strap having a first end with a helmet mounting feature and a second end attached to the first opposing strap side of the adjustable second strap. The adjustable second strap has a first end with a helmet mounting feature and a second end. The second strap passes behind the first opposing strap side, over the cross bar, and behind the second opposing strap side of the second strap slider. The second strap then extends through the first strap slider to wrap around the second opposing side before returning to the second strap slider. The second end of the second strap is attached to the second opposing strap side of the second strap slider. The tightening strap portion is attached to the first opposing strap side of the second strap slider and extends toward the first end of the second strap to enable manual adjustment of the second strap slider away from the first strap slider, decreasing an effective longitudinal length of the second strap. The loosening strap portion is coupled to the second opposing side of the second strap slider and extends toward the static first strap to enable manual adjustment of the second strap slider toward the first strap slider, increasing the effective longitudinal length of the second strap.

In another aspect, the present disclosure provides a tactical helmet having a helmet shell that receives a helmet lining. The helmet retention harness is attached to the helmet shell to enable a wearer to retain the tactical helmet on their head. The OHMA assembly enables one-handed adjustments while being worn for comfort and to keep the wearer's head securely positioned against the helmet liner.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

A helmet retention harness of a tactical helmet includes a one-handed manual adjustment assembly to adjust an effective longitudinal length of a combination of a static first strap and an adjustable second strap. The static strap is attached to one side of a first strap slider. The adjustable second strap slides on another side of the first strap slider and is attached to a second strap slider have a cross bar that slides along the adjustable second strap. Tightening and loosening strap portions extend away from each side of the second strap slider enabling a wearer of the tactical helmet to readily pull on a selected strap portion to either tighten or loosen the helmet retention harness while wearing the tactical helmet.

Figure 1:
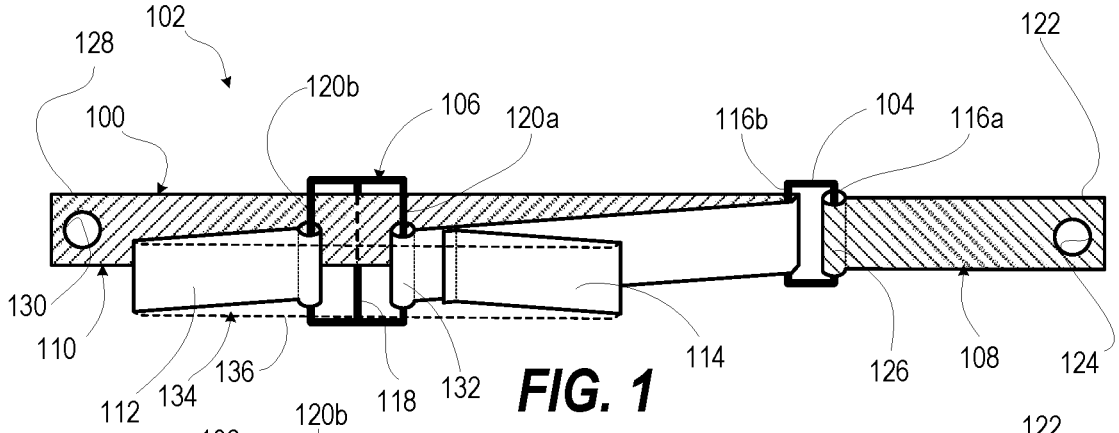
FIG. 1 illustrates a side view of a one-handed manual adjustment (OHMA) assembly of a helmet retention harness, according to one or more embodiments.
Figure 2:
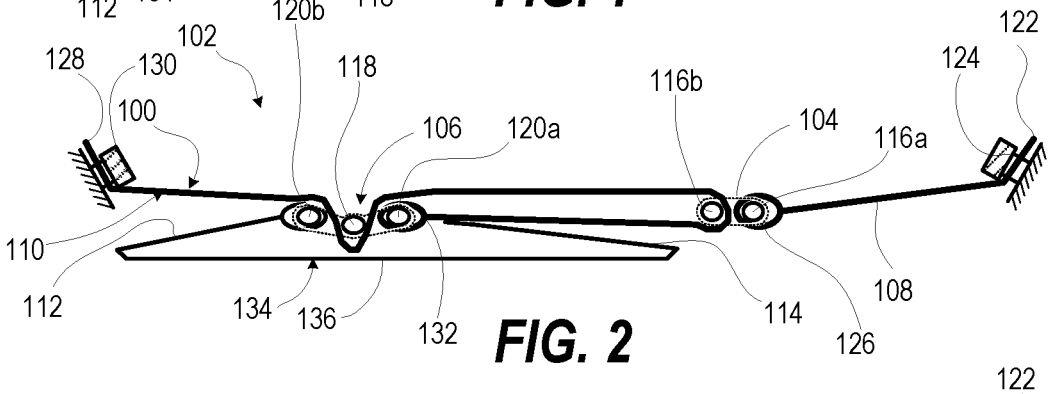
FIG. 2 illustrates a top view of the OHMA assembly of the helmet retention harness of FIG. 1, according to one or more embodiments.

FIG. 1 is a side view of a one-handed manual adjustment (OHMA) assembly 100 of a helmet retention harness 102. FIG. 2 is top view of the OHMA assembly 100 of the helmet retention harness 102. With reference to both FIGS. 1-2, the OHMA assembly 100 includes a first strap slider 104, a second strap slider 106, a static first strap 108, an adjustable second strap 110, a tightening strap portion 112; and a loosening strap portion 114. The first strap slider 104 has first and second opposing strap sides 116*a*-116*b*. The second strap slider 106 has a crossbar 118 between first and second opposing strap sides 120*a*-120*b*. The static first strap 108 has a first end 122 with a helmet mounting feature 124 and a second end 126 attached to the first opposing strap side 120*a* of the adjustable second strap 110. The adjustable second strap 110 has a first end 128 with a helmet mounting feature 130 and a second end 132. The second strap 110 passes behind the first opposing strap side 116*a*, over the cross bar 118, and behind the second opposing strap side 116*b* of the second strap slider 106. The second strap 110 then extends through the first strap slider 104 to wrap around the second opposing side 116*b* before returning to the second strap slider 106. The second end 132 of the second strap 110 is attached to the second opposing strap side 120*b* of the second strap slider 106. The tightening strap portion 112 is attached to the first opposing strap side 120*a* of the second strap slider 106 and extends toward the first end 128 of the second strap 110. The tightening strap portion 112 enables manual adjustment of the second strap slider 106 away from the first strap slider 104, decreasing an effective longitudinal length of the second strap 110. The loosening strap portion 114 is coupled to the second opposing side 120*b* of the second strap slider 106 and extends toward the static first strap 108. The loosening strap portion 114 enables manual adjustment of the second strap slider 106 to vary the effective longitudinal length of the second strap.

The strap segments may be fabricated from any suitable material as should be apparent to one of skill in the art. For example, and without limitation, the strap segments may be formed from nylon strap webbing as is known in the art.

Figure 3:
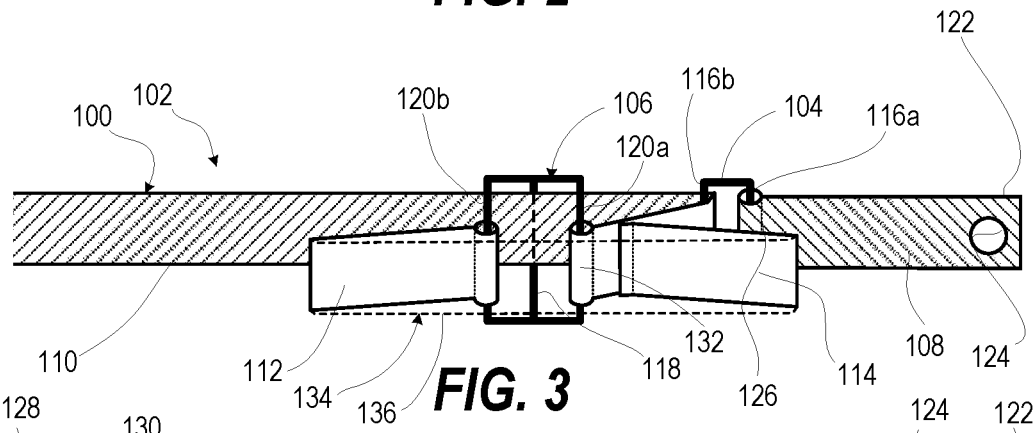
FIG. 3 illustrates a side view of the OHMA assembly of the helmet retention harness of FIG. 1 in a tightened state, according to one or more embodiments.
Figure 4:
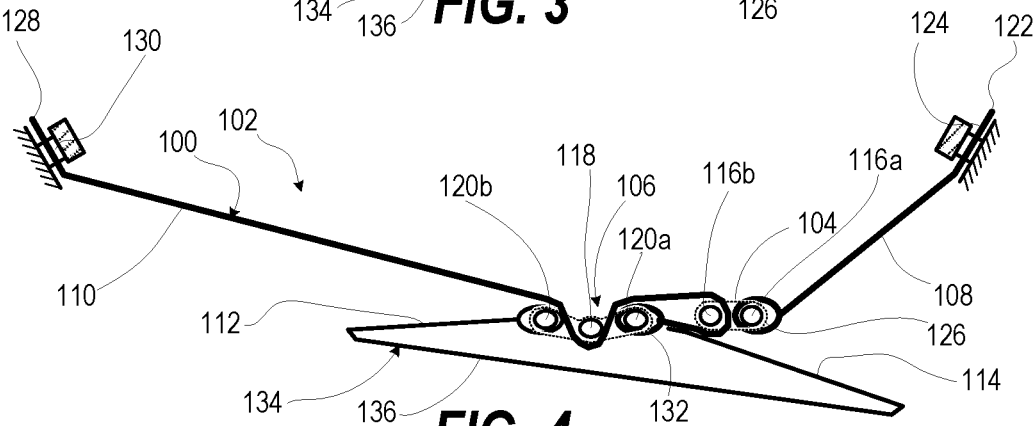
FIG. 4 illustrates a top view of the OHMA assembly of the helmet retention harness of FIG. 1 in a tightened state, according to one or more embodiments.

In one or more embodiments, the OHMA assembly 100 further includes a third strap 134. The tightening strap portion 112 is at a first end of the third strap 134. The loosening strap portion 114 is at a second end of the third strap 134. A central strap portion 136 is a folded back and flattened portion of a loop formed in the third strap 134. extending between oppositely and distally extending ends of the tightening strap portion 112 and the loosening strap portion 114. The central strap portion 136 covers the second strap slider 106 enables the manual adjustment of the second strap slider 106 in both directions. FIG. 3 illustrates a side view of the OHMA assembly 100 of the helmet retention harness 102 in a tightened state. FIG. 4 illustrates a top view of the OHMA assembly 100 of the helmet retention harness 102 in a tightened state.

Figure 5:
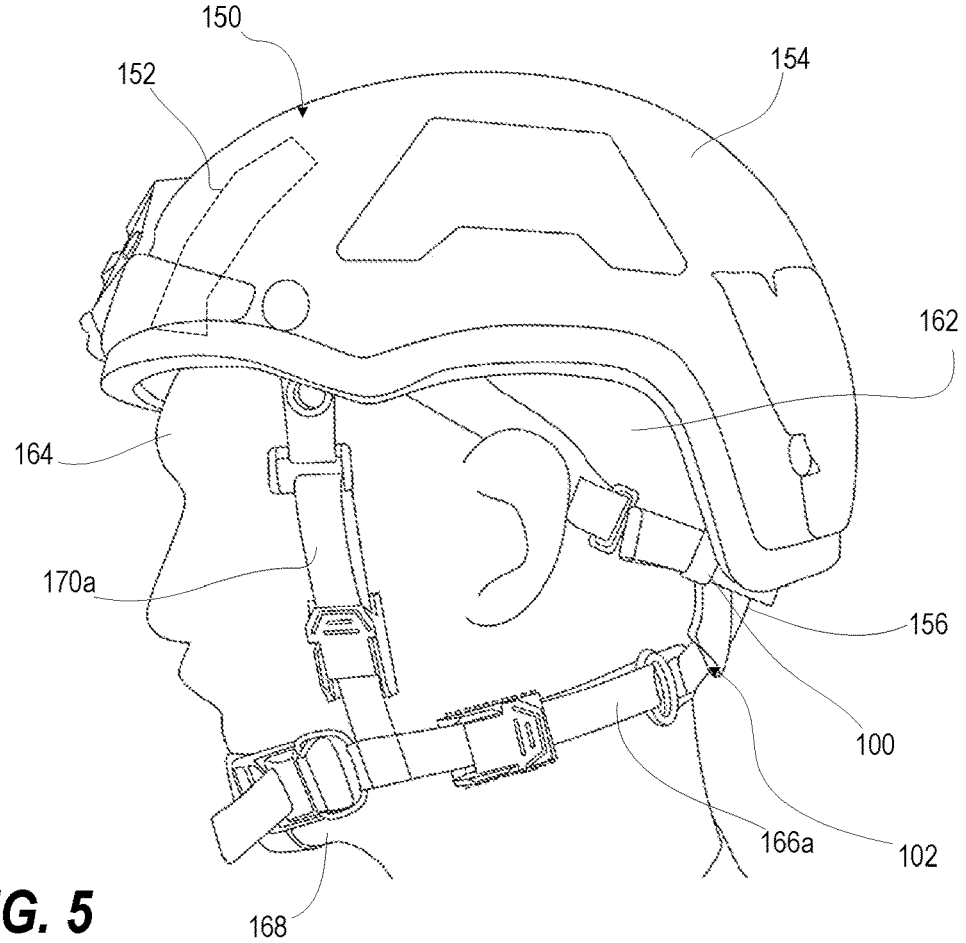
FIG. 5 is a left side view of a tactical helmet with an example helmet retention harness, according to one or more embodiments.
Figure 6:
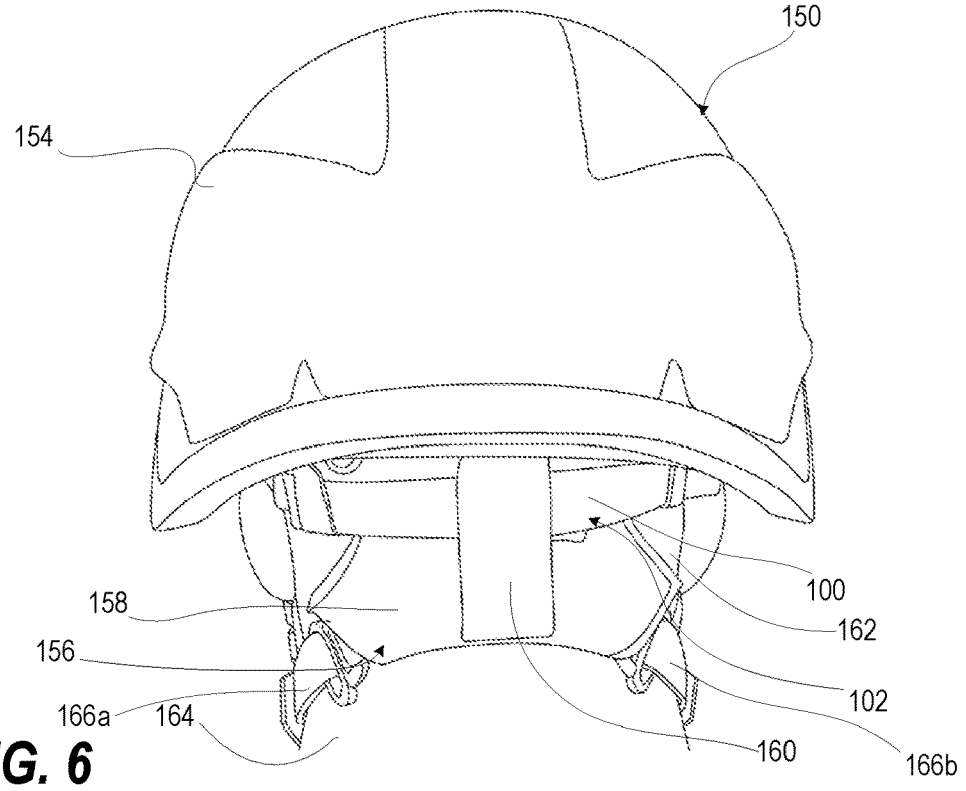
FIG. 6 is a back side view of the tactical helmet with the example helmet retention harness of FIG. 5, according to one or more embodiments.
Figure 7:
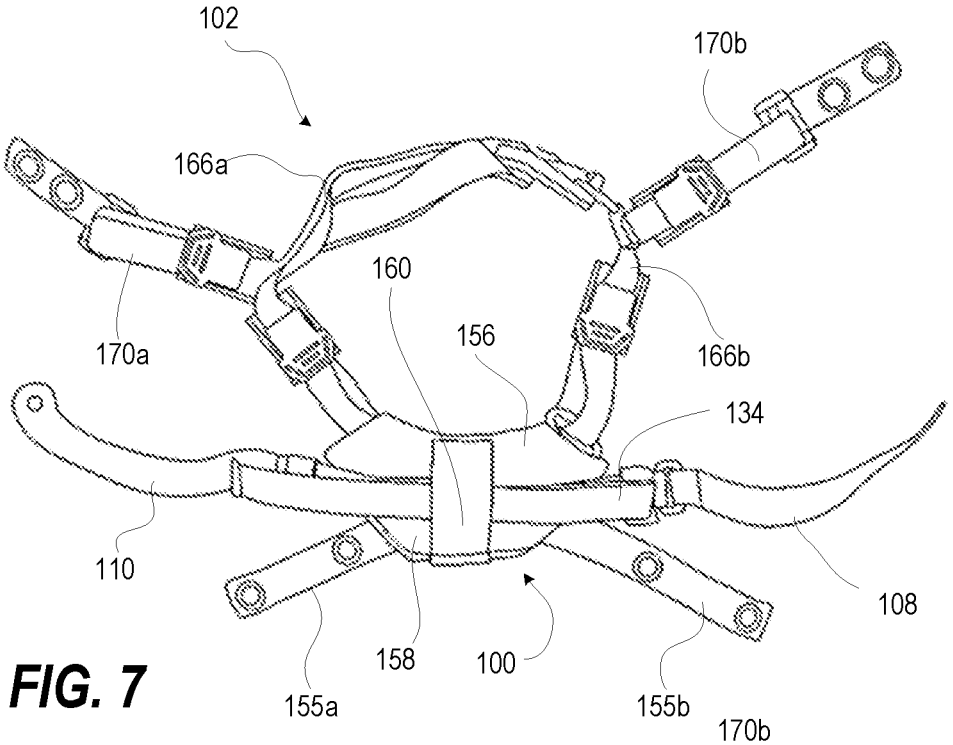
FIG. 7 is a three-dimensional view of the example helmet retention harness of FIG. 5 in a loosened state, according to one or more embodiments.
Figure 8:
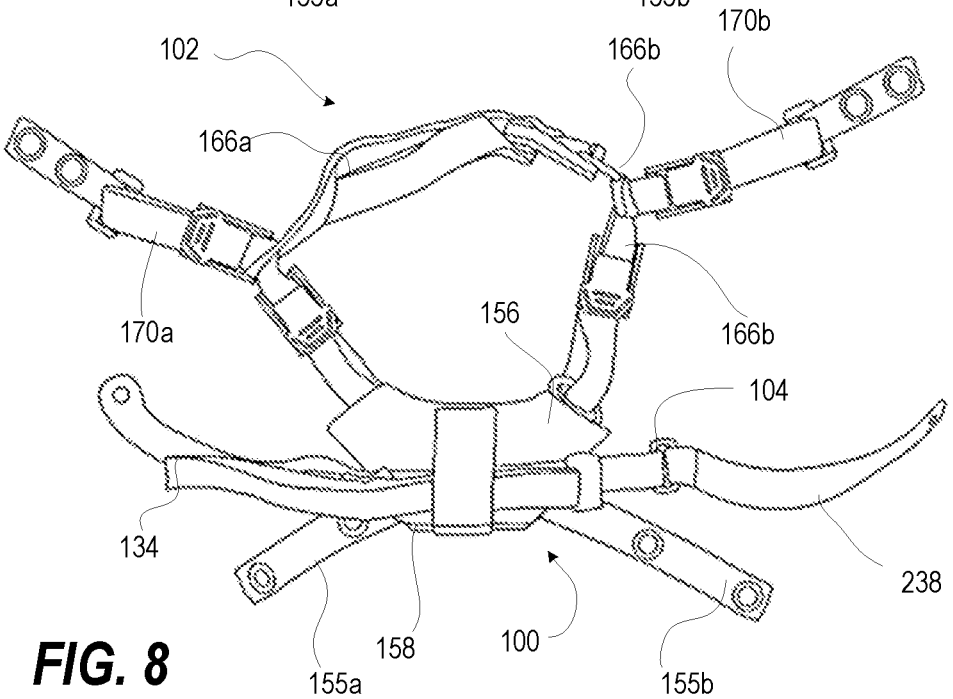
FIG. 8 is a three-dimensional view of the example helmet retention harness of FIG. 5 in a tightened state, according to one or more embodiments.

FIG. 5 is a left side view of a tactical helmet 150 with an example helmet retention harness 102. FIG. 6 is a back side view of the tactical helmet 150 with the example helmet retention harness 102. FIG. 7 is a three-dimensional view of the example helmet retention harness of FIG. 5 in a loosened state. FIG. 8 is a three-dimensional view of the example helmet retention harness of FIG. 5 in a tightened state. The tactical helmet 150 has a helmet liner 152 received in the helmet shell 154. The helmet retention harness 102 includes a rear harness portion 156. The rear harness portion 156 includes a rear pad 158 with rearward vertical retention loop 160 attached at top and bottom to the rear pad 158 (FIG. 6). The rear harness portion 156 is attachable to a rear portion of the helmet shell 154 via left and right tabs 155*a*-155*b* extending downward to contact a back lower portion of a head 162 of a wearer 164. The helmet retention harness 102 includes left and right harness portions 166*a*-166*b* (FIG. 7) extending from the rear harness portion 156 and attachable at forward ends to engage a chin 168 of the wearer 164. The helmet retention harness 102 includes left and right temple straps 170*a*-170*b* (FIG. 7) having respective top ends 172*a*-172*b* attachable to respective forward lateral sides of the helmet shell 154 and extending down to engage to the left and right harness portions 166*a*-166*b* (FIG. 7) proximate to the chin 168 of the wearer 164. The OHMA assembly 100 is received for lateral sliding adjustment through the along a backside of the rear pad 158 of the rear harness portion 156 and through the vertical retention loop 160. The OHMA assembly 100 and the helmet retention harness 102 are allowed to free float within the rear harness portion 156 including the rear pad 158 and the vertical retention loop 160. With particular reference to FIGS. 7-8, the respective helmet mounting features 124, 130 of the first ends 122, 128 of the static first strap 108 and the adjustable second strap 110 attachable to the respective forward lateral sides of the helmet shell 154. The same attachment points can used as the top ends 172*a*-172*b* of the left and right temple straps 170*a*-170*b*.

The helmet shell may include one or more features which are conducive for employing the helmet assembly in one or more a particular applications. For example, and without limitation, it may be desirable to provide a military combat helmet with features that permit attachment of accessories to the helmet.

Attaching accessories could create an imbalance of the helmet on a wearer's head and potentially lead to undesirable movement (e.g., bounce, rotation, pitch, and yaw) of the helmet during operational maneuvers. The impact of such imbalances on undesirable movement may be reduced using retention and fit systems, such as described above, to retain and stabilize the helmet on the wearer's head.

In one embodiment shown in FIGS. 5-6, the helmet shell may include a plurality of vent openings to help reduce the temperature inside the helmet about the wearer's head. It is to be understood, however, that ventilation openings are not required, and for some applications, such as ballistic protection, may not be desired.

The helmet shell may be fabricated from any suitable material for a particular application as should be apparent to one of skill in the art. For example, and without limitation, the shell may be fabricated from ballistic material for military combat applications. For non-ballistic protection, the helmet shell may be fabricated from plastic and/or composite materials as should be apparent to one of skill.

In one embodiment, the helmet assembly may include an impact liner located within the helmet shell for absorbing impact forces delivered to the shell. To facilitate fabrication and assembly, the impact liner may include multiple liner sections that are separately attached to the shell. The impact liner may include one or more features for accommodating aspects of the helmet assembly. For example, the impact liner may include, but is not limited to, ventilation openings for aligning with similar openings in the shell, recesses or through openings for accommodating mounting fasteners for securing the retention system and accessory mounts to the shell. The impact liner may be fabricated from any material suitable for absorbing high impact forces delivered to the helmet shell as should be apparent to one of skill in the art. For example, and without limitation, the impact liner may be molded from a high density foam material.

The impact liner may be attached to the shell using any suitable fastening technique as should be apparent to one of skill in the art. For certain applications, the impact liner may be permanently attached to the shell. For other applications, it may be desirable for the impact liner to be detachable from the shell to permit replacement of the impact liner or sections of the liner. For example, and without limitation, the impact liner sections may be secured to the shell using an adhesive and/or fasteners, such as screws, rivets, hook-and-loop or other touch fasteners.

In one embodiment, the helmet assembly may include a comfort liner positioned within the impact liner for cushioning the wearer's head from impact forces absorbed by the impact liner. The comfort liner may also assist with retention and/or stabilization of the helmet assembly in conjunction with the retention and fit systems. To facilitate fabrication and assembly, the comfort liner may include multiple comfort pads that are separately attachable to the impact liner shell.

The comfort liner may be fabricated from any material suitable for cushioning the wearer's head from impact forces absorbed by the impact liner as should be apparent to one of skill in the art. For example, and without limitation, the comfort liner may be fabricated from a relatively soft, resilient foam or elastomeric material covered with a fabric material suitable for such applications. The comfort liner may be attached to the shell using any suitable fastening technique as should be apparent to one of skill in the art. The comfort liner may be detachably attached to the shell to permit replacement of the comfort liner or selected comfort pads. For example, and without limitation, the comfort pads may be secured to the impact liner using hook-and-loop fasteners, such as VELCRO, or other touch fasteners, although other detachable fastening arrangements are contemplated.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A helmet retention harness comprising:

a one handed manual adjustment assembly comprising:

a first strap slider having first and second opposing strap sides;

a second strap slider having a crossbar between first and second opposing strap sides;

a static first strap having a first end with a helmet mounting feature and a second end attached to the first opposing strap side of the adjustable second strap;

an adjustable second strap having a first end with a helmet mounting feature and a second end, the second strap passing behind the first opposing strap side, over the cross bar, and behind the second opposing strap side of the second strap slider and extending through the first strap slider to wrap around the second opposing side before returning to the second strap slider, the second end of the second strap attached to the second opposing strap side of the second strap slider;

a tightening strap portion attached to the first opposing strap side of the second strap slider and extending toward the first end of the second strap to enable manual adjustment of the second strap slider away from the first strap slider, decreasing a longitudinal length of the second strap; and a loosening strap portion coupled to the second opposing side of the second strap slider and extending toward the static first strap to enable manual adjustment of the second strap slider toward the first strap slider, increasing the longitudinal length of the second strap.

2. The helmet retention harness of claim 1, further comprising:

a rear harness portion attachable to a rear portion of a helmet shell extending downward to contact a back lower portion of a wearer's head;

left and right harness portions extending from the rear harness portion and attachable at forward ends to engage a chin of the wearer; and left and right temple straps having respective top ends attachable to respective forward lateral sides of the helmet shell and extending down to engage to the left and right harness portions proximate to the chin of the wearer, wherein the one-handed manual adjustment assembly is received for lateral sliding adjustment through the rear harness portion with the respective helmet mounting features of the first ends of the static first strap and the adjustable second strap attachable to the respective forward lateral sides of the helmet shell.

3. The helmet retention harness of claim 1, wherein the one handed manual adjustment assembly further comprises a third strap comprising: (i) the tightening strap portion at a first end and; and (ii) the loosening strap portion at a second end; and (iii) a central strap portion extending between oppositely and distally extending ends of the tightening strap portion and the loosening strap portion, the central strap portion covering the second strap slider to enable manual adjustment of the second strap slider in both directions to vary the effective longitudinal length of the second strap.

4. A tactical helmet comprising:

a helmet shell;

a helmet liner received in the helmet shell; and a helmet retention harness comprising:

a one handed manual adjustment assembly comprising:

a first strap slider having first and second opposing strap sides;

a second strap slider having a crossbar between first and second opposing strap sides;

a static first strap having a first end with a helmet mounting feature and a second end attached to the first opposing strap side of the adjustable second strap;

an adjustable second strap having a first end with a helmet mounting feature and a second end, the second strap passing behind the first opposing strap side, over the cross bar, and behind the second opposing strap side of the second strap slider and extending through the first strap slider to wrap around the second opposing side before returning to the second strap slider, the second end of the second strap attached to the second opposing strap side of the second strap slider;

a tightening strap portion attached to the first opposing strap side of the second strap slider and extending toward the first end of the second strap to enable manual adjustment of the second strap slider away from the first strap slider, decreasing a longitudinal length of the second strap; and a loosening strap portion coupled to the second opposing side of the second strap slider and extending toward the static first strap to enable manual adjustment of the second strap slider toward the first strap slider, increasing the longitudinal length of the second strap.

5. The tactical helmet of claim 4, wherein the helmet retention harness further comprises:

a rear harness portion attachable to a rear portion of the helmet shell extending downward to contact a back lower portion of a wearer's head;

left and right harness portions extending from the rear harness portion and attachable at forward ends to engage a chin of the wearer; and left and right temple straps having respective top ends attachable to respective forward lateral sides of the helmet shell and extending down to engage to the left and right harness portions proximate to the chin of the wearer, wherein the one-handed manual adjustment assembly is received for lateral sliding adjustment through the rear harness portion with the respective helmet mounting features of the first ends of the static first strap and the adjustable second strap attachable to the respective forward lateral sides of the helmet shell.

6. The tactical helmet of claim 4, wherein the one handed manual adjustment assembly further comprises a third strap comprising: (i) the tightening strap portion at a first end and; and (ii) the loosening strap portion at a second end; and (iii) a central strap portion extending between oppositely and distally extending ends of the tightening strap portion and the loosening strap portion, the central strap portion covering the second strap slider to enable manual adjustment of the second strap slider in both directions to vary the effective longitudinal length of the second strap.

* * * * *